US009328600B2

(12) United States Patent
Kaminsky et al.

(10) Patent No.: US 9,328,600 B2
(45) Date of Patent: May 3, 2016

(54) DOUBLE HYDRAULIC FRACTURING METHODS

(75) Inventors: Robert D. Kaminsky, Houston, TX (US); Abdel Wadood M. El-Rabaa, Plano, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 259 days.

(21) Appl. No.: 13/825,107

(22) PCT Filed: Oct. 19, 2011

(86) PCT No.: PCT/US2011/056913

§ 371 (c)(1), (2), (4) Date: Mar. 19, 2013

(87) PCT Pub. No.: WO2012/074614

PCT Pub. Date: Jun. 7, 2012

(65) Prior Publication Data

US 2013/0306315 A1 Nov. 21, 2013

Related U.S. Application Data

(60) Provisional application No. 61/419,569, filed on Dec. 3, 2010.

(51) Int. Cl.
*E21B 43/267* (2006.01)

(52) U.S. Cl.
CPC ..... *E21B 43/267* (2013.01)

(58) Field of Classification Search
CPC ..... E21B 43/26; E21B 43/17; E21B 43/267
See application file for complete search history.

(56) References Cited

U.S. PATENT DOCUMENTS

| | | | | |
|---|---|---|---|---|
| 3,372,752 | A | 3/1968 | Prater | |
| 4,993,491 | A | 2/1991 | Palmer et al. | |
| 5,159,979 | A | 11/1992 | Jennings, Jr. | |
| 5,411,091 | A * | 5/1995 | Jennings, Jr. | 166/280.1 |
| 5,417,284 | A | 5/1995 | Jones | |
| 6,364,015 | B1 * | 4/2002 | Upchurch | E21B 49/008 166/250.1 |
| 6,394,184 | B2 | 5/2002 | Tolman et al. | |
| 6,488,082 | B2 | 12/2002 | Echols et al. | |
| 6,543,538 | B2 | 4/2003 | Tolman et al. | |
| 6,547,011 | B2 | 4/2003 | Kilgore | |

(Continued)

OTHER PUBLICATIONS

Britt, L. K. et al., "The Geomechanics of a Shale Play: What Makes a Shale Prospect!", SPE125525, 2009 SPE Eastern Regional Meeting, Sep. 23-25, 2009, Charleston, WV, pp. 1-9.

*Primary Examiner* — Zakiya W Bates
*Assistant Examiner* — Crystal J Miller
(74) *Attorney, Agent, or Firm* — ExxonMobil Upstream Research-Law Department

(57) ABSTRACT

A method for hydraulically fracturing subterranean formations in a manner resulting in improved propping of fractures, particularly in ductile rock formations such as gas-containing shales having a high clay content. The method allows for improved hydrocarbon production. The method involves injecting a first fluid having a first proppant concentration into the subsurface formation to form a fracture, reducing the pressure in the fracture and allowing the fracture to substantially close, and injecting a second fluid having a second proppant concentration into the fracture to re-open the fracture. The second proppant concentration is greater than the first proppant concentration. A portion of the proppant is effectively retained in the reopened fracture.

23 Claims, 10 Drawing Sheets

(56) References Cited

U.S. PATENT DOCUMENTS

| | | | | |
|---|---|---|---|---|
| 7,082,993 | B2 * | 8/2006 | Ayoub et al. | 166/250.1 |
| 7,210,528 | B1 * | 5/2007 | Brannon et | 507/140 |
| 7,213,651 | B2 | 5/2007 | Brannon et al. | |
| 7,334,635 | B2 * | 2/2008 | Nguyen | 166/280.1 |
| 7,395,859 | B1 | 7/2008 | Hill | |
| 7,472,751 | B2 * | 1/2009 | Brannon et al. | 166/280.1 |
| 7,669,655 | B2 * | 3/2010 | Brannon | 166/250.1 |
| 7,726,399 | B2 | 6/2010 | Brannon et al. | |
| 7,735,556 | B2 * | 6/2010 | Misselbrook et al. | 166/281 |
| 7,918,277 | B2 * | 4/2011 | Brannon et al. | 166/280.2 |
| 8,127,850 | B2 * | 3/2012 | Brannon et al. | 166/308.1 |
| 2005/0003965 | A1 | 1/2005 | Xiao et al. | |
| 2008/0032898 | A1 * | 2/2008 | Brannon et al. | 507/100 |
| 2008/0271889 | A1 * | 11/2008 | Misselbrook et al. | 166/280.1 |
| 2009/0107674 | A1 * | 4/2009 | Brannon et al. | 166/280.2 |
| 2009/0221453 | A1 * | 9/2009 | Mukhopadhyay et al. | 507/202 |
| 2009/0255668 | A1 | 10/2009 | Fleming et al. | |
| 2010/0116500 | A1 | 5/2010 | Brannon | |
| 2011/0036583 | A1 | 2/2011 | Willberg et al. | |
| 2011/0272159 | A1 * | 11/2011 | Osiptsov et al. | 166/308.1 |

* cited by examiner

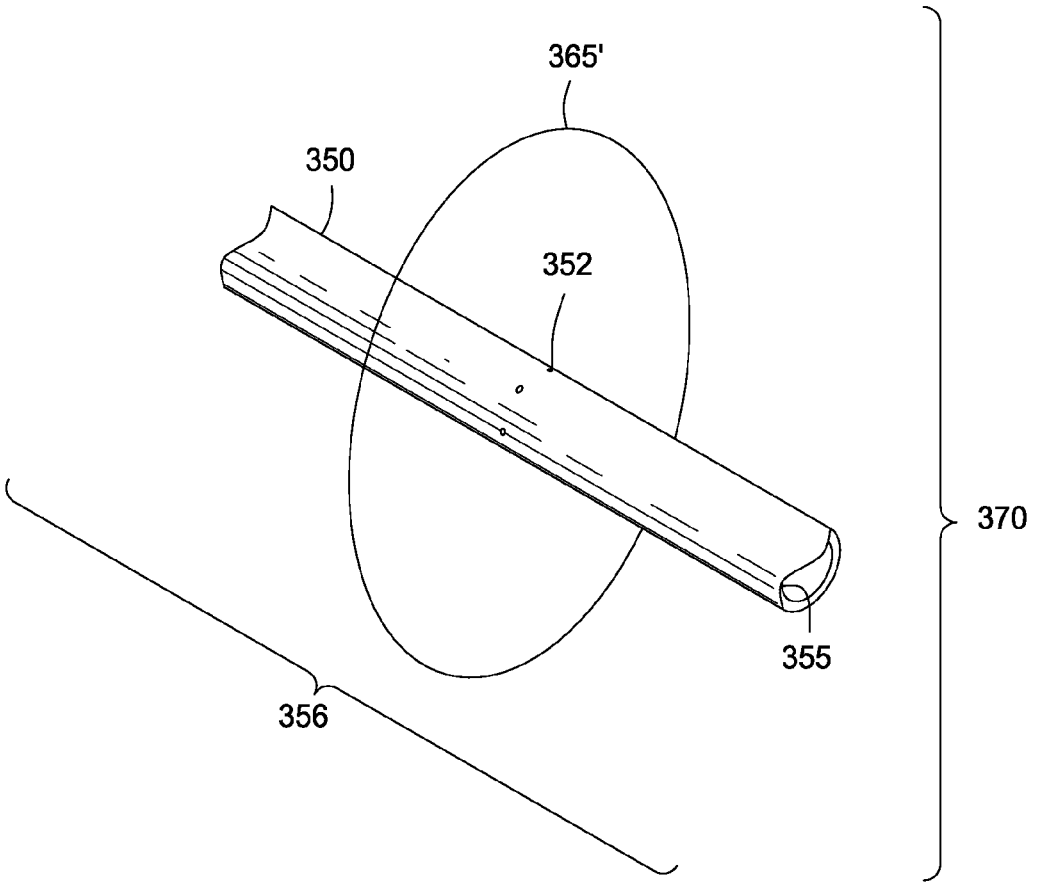
FIG. 4B (1)
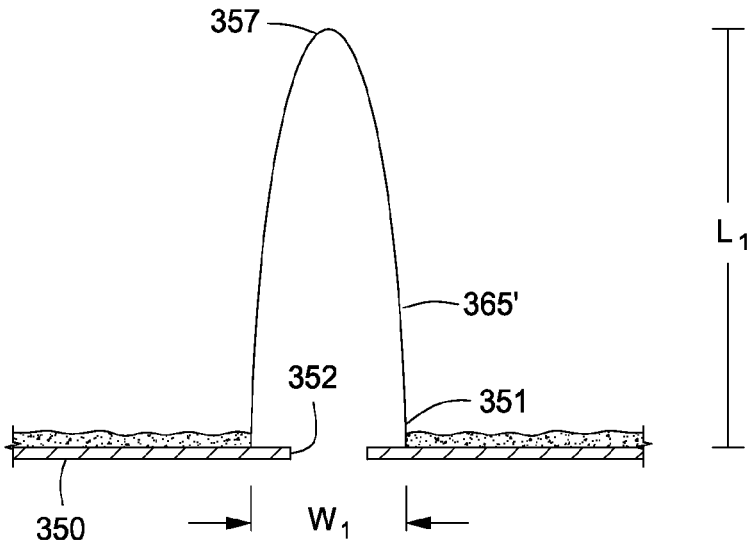
FIG. 4B (2)

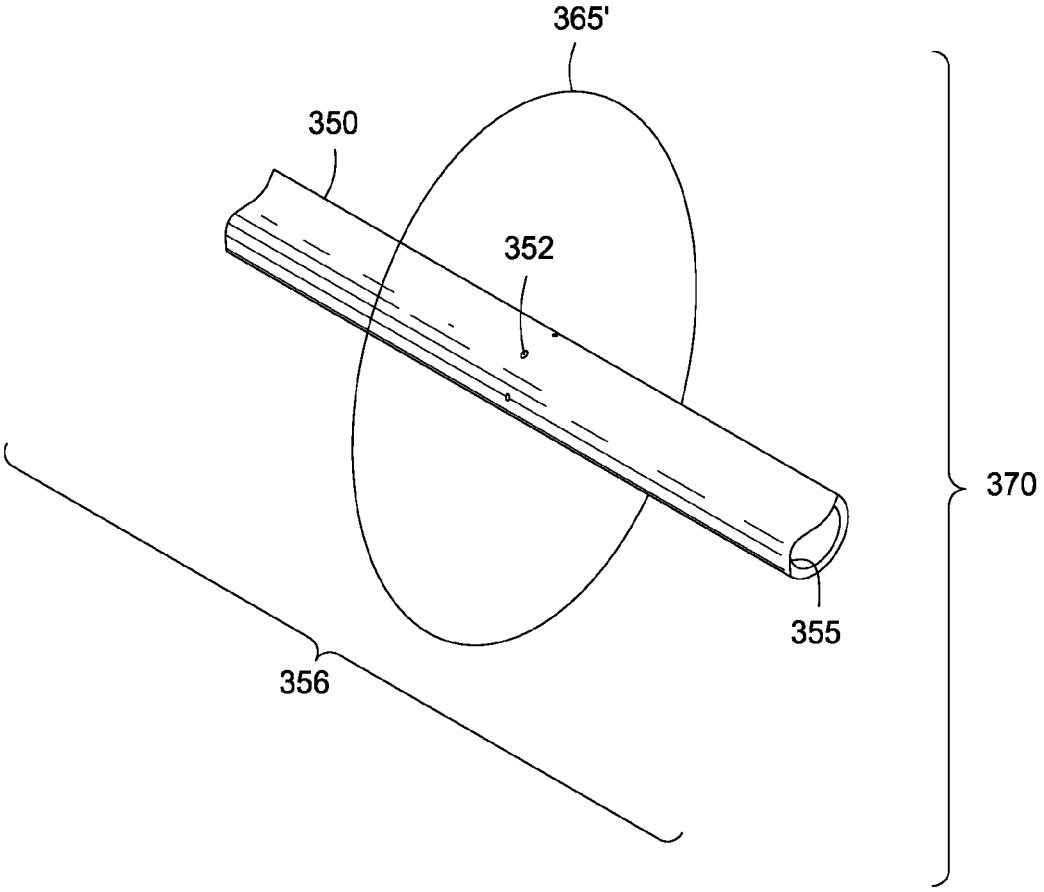
FIG. 4C (1)
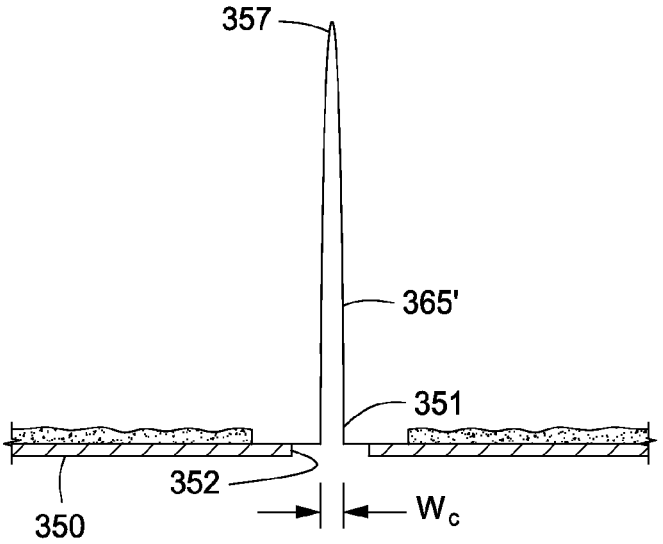
FIG. 4C (2)

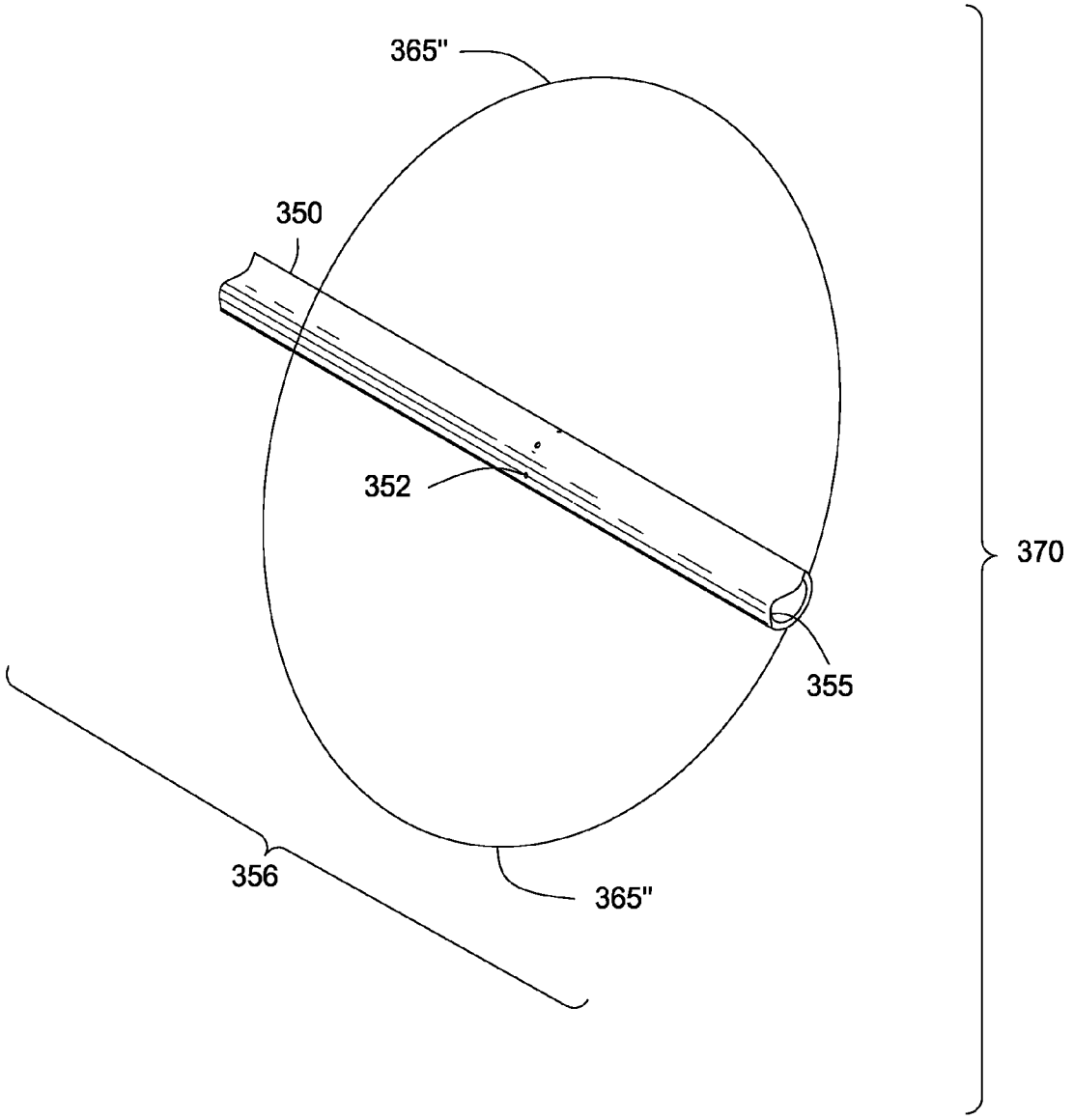
FIG. 4D (1)

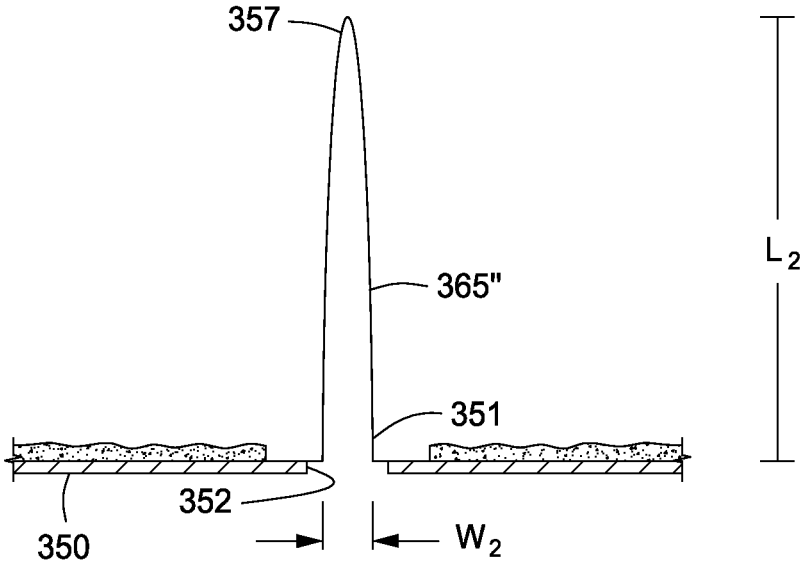
FIG. 4D (2)

DOUBLE HYDRAULIC FRACTURING METHODS

CROSS REFERENCE TO RELATED APPLICATIONS

This application is the National Stage of International Application No. PCT/US11/56913, filed Oct. 19, 2011, which claims the benefit of U.S. Provisional Application 61/419,569, filed Dec. 3, 2010, the entirety of which is incorporated herein by reference for all purposes.

BACKGROUND

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

Field

This disclosure and the inventions described herein generally relates to the recovery of hydrocarbon fluids from a subsurface formation. More specifically, the inventions relate to methods for fracturing a subsurface formation in order to enhance the flow of hydrocarbon fluids through a rock matrix and towards a wellbore.

General Discussion of Technology

In the drilling of oil and gas wells, a wellbore is formed using a drill bit that is urged downwardly at a lower end of a drill string. As the wellbore progresses through different depths, the drill string and bit are removed and the wellbore is lined with strings of casing. An annular area is thus formed between the strings of casing and the surrounding formations.

A cementing operation is typically conducted in order to fill or "squeeze" the annular areas with cement. This serves to form cement sheaths. The combination of cement and casing strengthens the wellbore and facilitates the isolation of subsurface intervals behind the casing.

It is common to place several strings of casing having progressively smaller outer diameters into the wellbore. The process of drilling and then cementing progressively smaller strings of casing is repeated until the well has reached total depth. The final string of casing, referred to as a production casing, is cemented into place. In some instances, the final string of casing is a liner, that is, a string of casing that is not tied back to the surface, but is hung from the lower end of the preceding string of casing.

As part of the completion process, the production casing is perforated at desired depths. This means that lateral holes are shot through the casing and the cement sheath surrounding the casing. This provides fluid communication between the wellbore and the surrounding formation. Thereafter, the formation may be fractured or otherwise prepared for production of formation fluids.

Hydraulic fracturing consists of injecting fluids into a subsurface interval at such high pressures and rates that the reservoir rock fails and forms a fracture or a network of fractures. The fluid may be a viscous fracturing fluid, which is typically a shear thinning, non-Newtonian gel or emulsion. The fracturing fluid may be mixed with a granular proppant material such as sand, ceramic beads, or other granular materials. The proppant serves to hold the fracture open after the hydraulic pressures are released. The combination of fractures and injected proppant increases the flow capacity of the treated reservoir.

In order to further stimulate the formation and to clean the near-wellbore regions downhole, an operator may choose to "acidize" the formation. This is done by injecting an acid solution down the wellbore and into the perforations. In operation, the drilling company injects a concentrated formic acid, acetic acid, or other acidic composition into the wellbore, and directs the fluid into selected intervals of interest. The acid helps to dissolve carbonate material, thereby opening up porous channels through which hydrocarbon fluids may flow into the wellbore. In addition, the acid helps to break up or dissolve drilling mud that may have invaded the formation.

Application of hydraulic fracturing and acid stimulation as described above is a routine part of petroleum industry operations as applied to individual target intervals. Such target intervals may represent up to about 60 meters (200 feet) of gross, vertical thickness of subterranean formation. When there are multiple or layered reservoirs to be hydraulically fractured, or a very thick hydrocarbon-bearing formation, such as over about 40 meters (135 feet), then more complex treatment techniques are required to obtain treatment of the entire target formation. In this respect, the operating company must isolate various intervals to ensure that each separate interval is not only perforated, but adequately fractured and treated. The operator may then direct fracturing fluid and stimulant through perforations and into each interval of interest to effectively increase the flow capacity along the desired depths.

Fracturing operations are particularly important when seeking to produce hydrocarbon fluids from low-permeability reservoirs. Gas shales, coalbed methane, and tight gas sands are examples of low-permeability hydrocarbon reservoirs of commercial interest. Such formations may have, for example, a permeability of less than 50 millidarcies, or sometimes less than 10 millidarcies, or even less than 1 millidarcy.

Some low-permeability hydrocarbon reservoirs, such as some shale gas formations, are composed of relatively ductile rock. Ductility is typically associated with formations containing high clay content. SPE Paper No. 125,525, L. K. Britt and J. Schoeffler, "*The Geomechanics of a Shale Play: What Makes a Shale Prospective*," (2009) describes ductility in gas-containing shales. Clay species may include kaolonite, illite, and smectite, among others. In addition to clays, shales may be comprised of quartz and carbonate components.

Ductility within formations hinders effective hydraulic fracturing since ductility increases the energy required to propagate a fracture, which in turn tends to cause short, wide fractures rather than preferred long, narrow fractures. Short, wide fractures are less preferred since they contact less of the formation and the amount of fluid and proppant required to fill them may be increased. Moreover, wide fractures may promote poor distribution of proppant within the fracture since the width may allow proppant to readily settle to the bottom of the fracture during injection.

SUMMARY

Methods for forming propped fractures in a subsurface formation are provided herein. In the methods, the fractures are formed outwardly from a wellbore. The formation is preferably a ductile formation. For example, the formation may be a formation, such as a gas-containing shale, having a Poisson's ratio greater than about 0.25. Alternatively, the formation may be a shale formation having a Young's Modulus that is less than about $3.5\times10^6$ psi ($2.4\times10^4$ MPa).

The methods first comprise injecting a first fluid into the subsurface formation. This is a first injecting step, and serves to form the one or more fractures with lengths (e.g., at least well-to-tip lengths of up to 200 ft, 400 ft, 800 ft, or even greater than 800 ft) suitable for commercial production rates (e.g., >1000 KSCFD of gas from a single wellbore) at the end of the overall procedure. The amount of first fluid injected may be predetermined to generate a first fracture of approximately a desired length.

The first fluid has a first proppant concentration. Preferably, the proppant concentration may be effectively zero. Alternatively, the proppant concentration in the first fluid may be less than about 10% vol.

The methods also include reducing the pressure in the one or more fractures. The pressure is reduced to a pressure below a minimum confining stress. This causes the fracture to substantially close. Allowing the fracture to substantially close will force fluid out of the fracture. This is particularly true where a wide fracture is formed in a ductile formation, and where the proppant concentration is low.

The methods further include injecting a second fluid into the one or more fractures. This injecting step represents a second injecting step. The second fluid is injected into the fracture formed from the first injecting step. Thus, the second injecting step takes advantage of the flow paths created in the first injecting step to re-open the fracture.

The second fluid that is injected in the second injecting step has a second proppant concentration. The second proppant concentration is greater than the first proppant concentration.

The methods include again reducing the pressure in the fractures. In accordance with the methods, proppant remains in the one or more fractures after pressure is reduced. In this way, propped fractures are created In one aspect, the fracture has an estimated first length after the first injecting step, and then an estimated second length after the second injecting step. Preferably, the amount of first fluid injected is predetermined to generate a fracture of the estimated first length, while the amount of second fluid injected is predetermined to generate a fracture of the estimated second length. Fracture length may be estimated through any of several methods known in the art. For example, fracture length may be estimated by modeling based on injected fluid volumes, fluid rheology, rock permeability, and rock mechanics. Fracture length may also be estimated by interpretation of micro-seismic data collected during hydraulic fracturing.

The first fluid, the second fluid, or both may also comprise an additive for reducing fluid leak-off into the formation. The additive may be, for example, a viscosifier or a particulate material.

The methods may be employed when the subsurface formation has more than one interval to be fractured. For example, the operator may provide propped fractures in one interval in accordance with the steps described above. The operator may then isolate the first interval from a second interval. Thereafter, the fracturing and propping steps are repeated for the second interval. Thereafter, the method may include re-opening fluid communication through the wellbore between the first interval and the second interval.

The processes described above may be employed for third, fourth, or more intervals. In any instance, the methods may finally include producing natural gas from the subsurface formation.

In some implementations, the first injection step is applied multiple times to create a plurality of fractures. The second injecting step is applied to simultaneously pressurize a plurality of fractures. The second fluid props two or more fractures in each of the intervals upon the reducing of pressure step.

In some implementations, the wellbore is formed to have a substantially horizontal well section. Here, the first interval, the second interval, and any additional intervals reside along the horizontal well section. The formed fractures preferably extend vertically from the wellbore in each interval.

BRIEF DESCRIPTION OF THE DRAWINGS

So that the present inventions can be better understood, certain drawings, charts, graphs and/or flow charts are appended hereto. It is to be noted, however, that the drawings illustrate only selected embodiments of the inventions and are therefore not to be considered limiting of scope, for the inventions may admit to other equally effective embodiments and applications.

FIGS. 4A, 4B(1), 4C(1), and 4D(1) provide perspective views of a production casing set within a wellbore. The casing is disposed substantially horizontally and has been perforated. The surrounding formation is incrementally undergoing fracturing in accordance with the present methods.

FIG. 4A shows a portion of the production casing having been perforated. Only one interval is shown.

FIG. 4B(1) shows the formation having been fractured by a first fluid. The fracture defines a fracture plane.

FIG. 4C(1) shows a next stage wherein pressure has been released from the formation. The fracture has contracted.

FIG. 4D(1) shows a next stage wherein a second fluid is injected through the perforations and into the formation. Here, the fracture has been re-opened.

FIG. 4B(2) shows an enlarged view of the first fracture from FIG. 4B(1). The first fracture has a first length $L_1$ and a first width $W_1$.

FIG. 4C(2) shows an enlarged view of the fracture from FIG. 4C(1). The fracture has contracted.

FIG. 4D(2) shows an enlarged side view of the fracture from FIG. 4D(1). This is the second fracture formed from re-opening the first fracture. Here, the second fracture is narrower than the first fracture.

DETAILED DESCRIPTION OF CERTAIN EMBODIMENTS

Definitions

Figure 1:
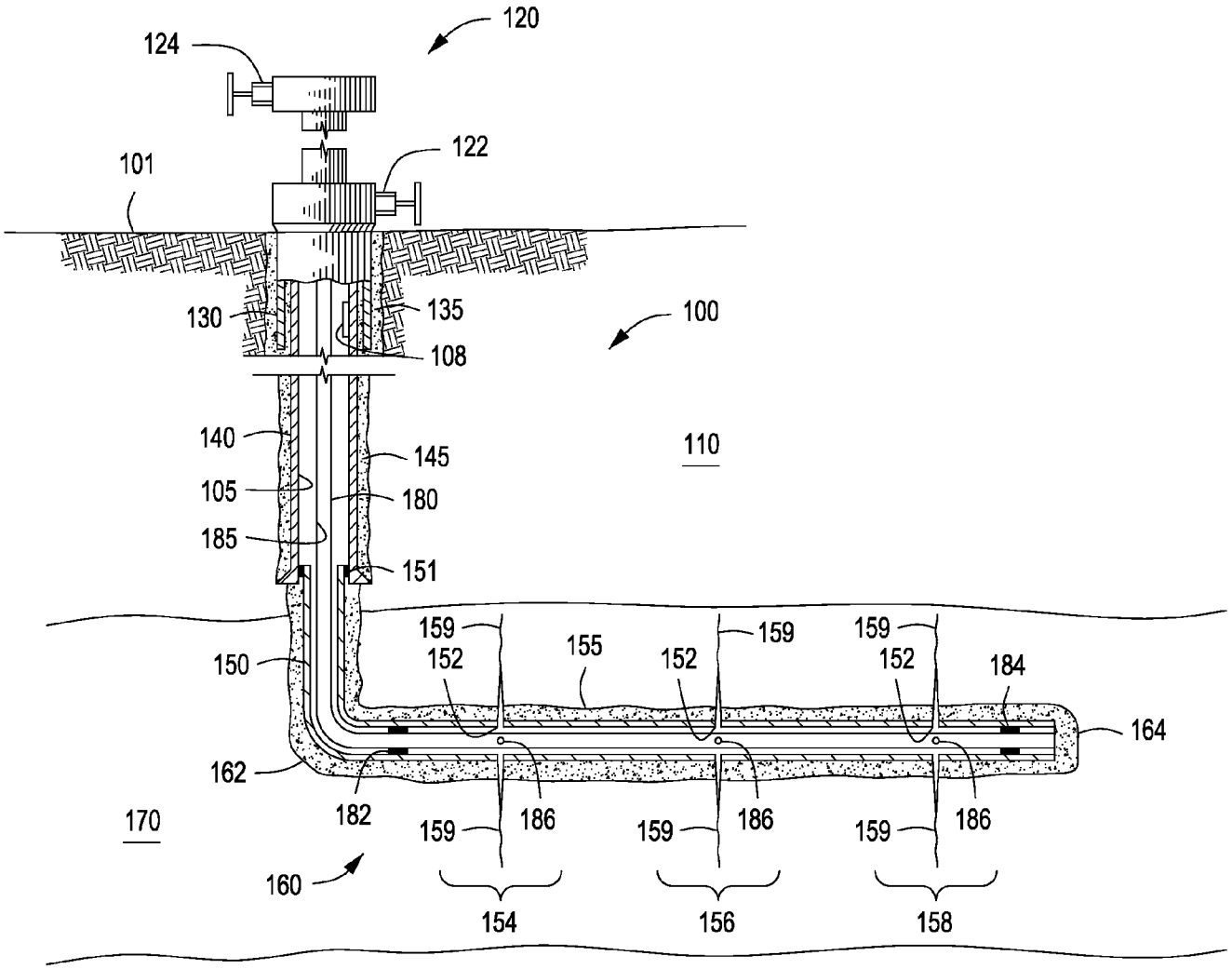
FIG. 1 is a cross-sectional view of a wellbore. The wellbore has been completed horizontally, and fractured along three separate illustrative intervals.

As used herein, the term "hydrocarbon" refers to an organic compound that includes primarily, if not exclusively, the elements hydrogen and carbon. Hydrocarbons may also include other elements, such as, but not limited to, halogens, metallic elements, nitrogen, oxygen, and/or sulfur. Hydrocarbons generally fall into two classes: aliphatic, or straight chain hydrocarbons, and cyclic, or closed ring hydrocarbons, including cyclic terpenes. Examples of hydrocarbon-containing materials include any form of natural gas, oil, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions or at ambient conditions (15° C. and 1 atm pressure). Hydrocarbon fluids may include, for example, oil, natural gas, coalbed methane, shale oil, pyrolysis oil, pyrolysis gas, a pyrolysis product of coal, and other hydrocarbons that are in a gaseous or liquid state.

As used herein, the terms "produced fluids" and "production fluids" refer to liquids and/or gases removed from a subsurface formation, including, for example, an organic-rich rock formation. Produced fluids may include both hydrocarbon fluids and non-hydrocarbon fluids. Production fluids may include, but are not limited to, oil, natural gas, pyrolyzed shale oil, synthesis gas, a pyrolysis product of coal, coalbed methane, carbon dioxide, hydrogen sulfide and water (including steam).

As used herein, the term "fluid" refers to gases, liquids, and combinations of gases and liquids, as well as to combinations of gases and solids, combinations of liquids and solids, and combinations of gases, liquids, and solids.

As used herein, the term "gas" refers to a fluid that is in its vapor phase at 1 atm and 15° C.

As used herein, the term "oil" refers to a hydrocarbon fluid containing primarily a mixture of condensable hydrocarbons.

As used herein, the term "subsurface" refers to geologic strata occurring below the earth's surface.

As used herein, the term "formation" refers to any definable subsurface region. The formation may contain one or more hydrocarbon-containing layers, one or more non-hydrocarbon containing layers, an overburden, and/or an underburden of any geologic formation.

The terms "interval" or "interval of interest" refer to a portion of a formation containing hydrocarbons. Alternatively, the formation may be a water-bearing interval.

As used herein, the phrase "length" of the fracture represents a distance from the wellbore to a fracture tip.

For purposes of the present patent, the term "production casing" includes a liner string or any other tubular body fixed in a wellbore along an interval of interest.

As used herein, the term "wellbore" refers to a hole in the subsurface made by drilling or insertion of a conduit into the subsurface. A wellbore may have a substantially circular cross section, or other cross-sectional shapes. The term "well", when referring to an opening in the formation, may be used interchangeably herein with the term "wellbore."

Description of Selected Specific Embodiments

The inventions are described herein in connection with certain specific embodiments. However, to the extent that the following detailed description is specific to a particular embodiment or a particular use, such is intended to be illustrative only and is not to be construed as limiting the scope of the inventions.

FIG. 1 is a cross-sectional view of an illustrative wellbore 100. The wellbore 100 defines a bore 105 that extends from a surface 101, and into the earth's subsurface 110. The bore 105 preferably includes a shut-in valve 108. The shut-in valve 108 controls the flow of production fluids from the wellbore 100 in the event of a catastrophic event at the surface 101.

The wellbore 100 includes a wellhead. The wellhead is shown schematically at 120. The wellhead 120 contains various items of flow control equipment such as a lower master fracturing valve 122 and an upper master fracturing valve 124. It is understood that the wellhead 120 will include other components during the formation and completion of the wellbore 100, such as a blowout preventer (not shown). In a subsea context, the wellhead 120 may also include a lower marine riser package.

The wellbore 100 has been completed by setting a series of pipes into the subsurface 110. These pipes include a first string of casing 130, sometimes known as surface casing or a conductor. These pipes also include a final string of casing 150, known as a production casing. The pipes also include one or more sets of intermediate casing 140. Typically, the string of surface casing 130 and the intermediate string of casing 140 are set in place using a cement sheath. A cement sheath 135 is seen isolating the subsurface 110 along the surface casing 130, while a separate cement sheath 145 is seen isolating the subsurface 110 along the intermediate casing 140. It is understood that some intermediate casing strings may not be fully cemented, depending on regulatory requirements.

The illustrative wellbore 100 is completed horizontally. A horizontal portion or wellbore section is shown at 160. The horizontal portion 160 has a heel 162. The horizontal portion 160 also has a toe 164 that extends through a subsurface formation 170. While the wellbore 100 is shown as a horizontal completion having a heel 162 and a toe 164, it is understood that the present inventions have equal application in deviated wells or even substantially vertical wells.

In FIG. 1, the horizontal portion 160 of the wellbore 100 extends laterally through the formation 170. The formation 170 may be a carbonate or sand formation having good consolidation but poor permeability. More preferably, however, the formation 170 is a shale formation having low permeability. In any instance, the formation 170 may have a permeability of less than 50 millidarcies, or less than 10 millidarcies, or even less than 1 millidarcy.

For the illustrative wellbore 100, the production casing 150 represents a liner. This means that the casing 150 does not extend back to the surface 101, but is hung from an intermediate string of casing 140 using a liner hanger 151. The production casing 150 extends substantially to the toe 164 of the wellbore 100, and is cemented in place with a separate cement sheath 155.

The horizontal portion 160 of the wellbore 100 extends for many hundreds of feet. For example, the horizontal portion 160 may extend for over 250 feet, or over 1,000 feet, or even more than 5,000 feet. Extending the horizontal portion 160 of the wellbore 100 such great distances increases the exposure of the low-permeability formation 170 to the wellbore 100.

To permit the in-flow of hydrocarbon fluids from the formation 170 into the production casing 150, the production casing 150 is perforated. Three sets of perforations 152 are shown in FIG. 1. While three sets of perforations 152 are shown, it is understood that the horizontal portion 160 may have many more sets of perforations 152 or may have few perforations.

In preparation for the production of hydrocarbons, the operator may wish to stimulate the formation 170 by circulating an acid solution. This serves to clean out residual drilling mud both along the wall of the borehole 105 and into the near-wellbore region (the region within formation 170 close to the production casing 150). In addition, the operator may wish to fracture the formation 170. This is done by injecting a fracturing fluid under high pressure through the perforations 152 and into the formation 170. The fracturing process creates fissures 159 along the formation 170 to enhance fluid flow into the production casing 150.

To facilitate the injection of fracturing fluid and stimulation fluid into the formation 170, the wellbore 100 may be apportioned into intervals. Preferably one, although possibly more, fractures may be generated in each interval. In the illustrative wellbore 100 of FIG. 1, the horizontal portion 160 is divided into three intervals—intervals 154, 156, and 158. While only three intervals are shown in FIG. 1, it is understood that a horizontally completed wellbore may be divided into numerous additional intervals or into fewer intervals. Each interval may represent, for example, a length of about 50 meters (164 feet), 100 meters (328 feet), or 200 meters (656 feet). In operation, the operator may fracture and treat each interval 154, 156, and 158 separately.

Where multiple intervals are being perforated and treated, it is desirable for the operator to isolate selected intervals. Known well completion processes require the use of special surface equipment to facilitate interval isolation. In the arrangement of FIG. 1, a working string such as coiled tubing is shown at 180. The coiled tubing 180 extends from the surface 101 and through the production casing 150. The coiled tubing 180 has a bore 185 which receives acidic fluid, hydraulic fluid, or other treating fluid.

The wellbore 100 of FIG. 1 also has a pair of isolation packers 182, 184. Isolation packer 182 is disposed near the heel 162 of the horizontal portion 160, while isolation packer 184 is disposed near the toe 164 of the horizontal portion 160. Inflating the isolation packers 182, 184 allows the operator to inject treating fluid through outlet ports 186 along the coiled tubing 180.

Figure 2:
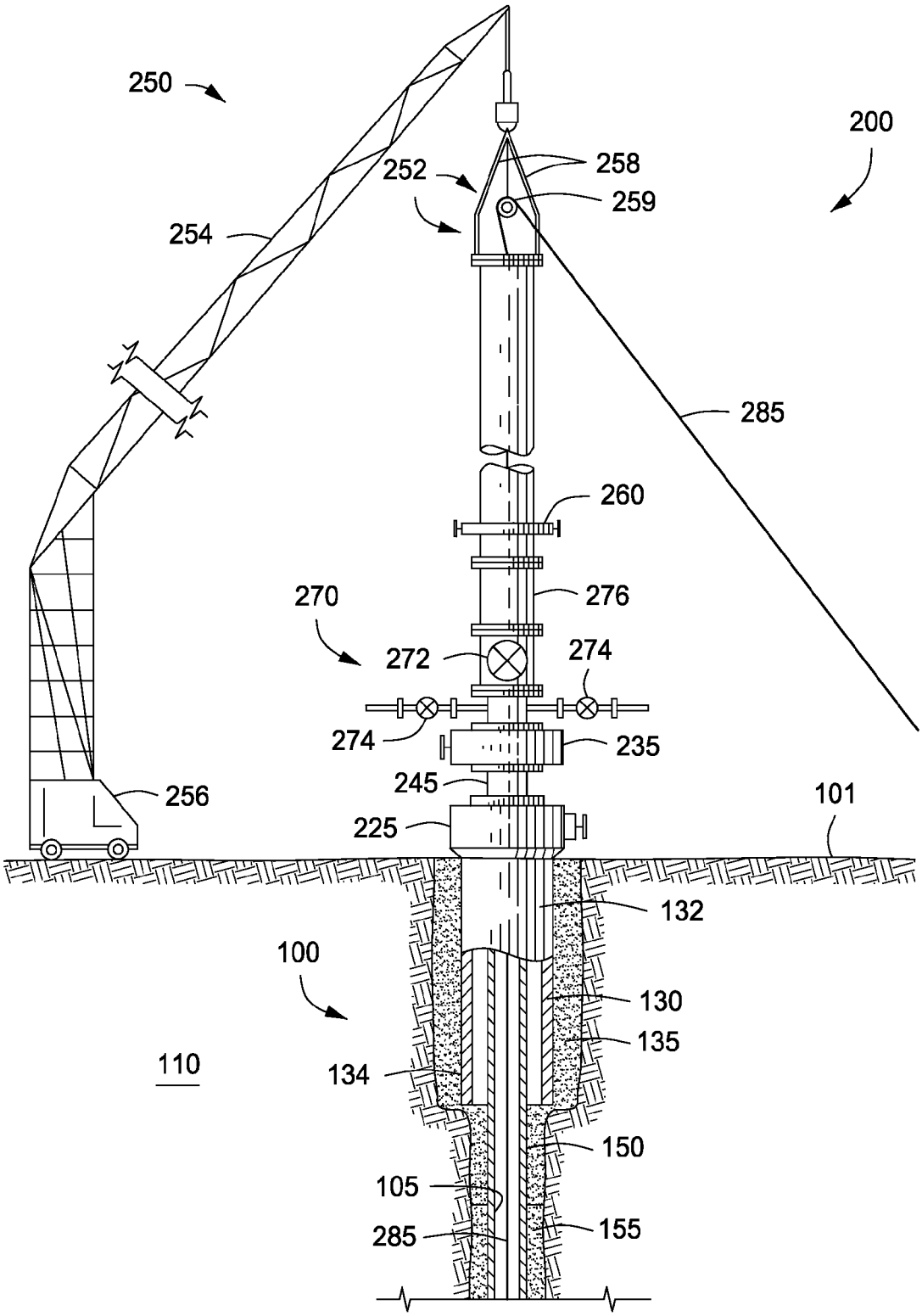
FIG. 2 presents a presents a side view of a well site wherein a well is being completed. Known surface equipment is provided to support wellbore tools (not shown) above and within a wellbore.

The coiled tubing 180 and packers 182, 184 represent a part of the completion equipment that is run into the wellbore 100. FIG. 2 presents a side view of a well site 200 wherein the wellbore 100 is being completed. The well site 200 is using known surface equipment 250 to support wellbore tools (not shown) above and within the wellbore 100. The tools may be, for example, a perforating gun assembly, a fracturing plug, isolation packers 182, 184 or other equipment for completing a well.

In FIG. 2, the surface equipment 250 first includes a lubricator 252. The lubricator 252 defines an elongated tubular device configured to receive wellbore tools (or a string of wellbore tools), and introduce them into the wellbore 100. In general, the lubricator 252 must be of a length greater than the length of the perforating gun assembly to allow the perforating gun assembly to be safely deployed in the wellbore 100 under pressure.

The lubricator 252 delivers a tool string in a manner where the pressure in the wellbore 100 is controlled and maintained. With readily-available existing equipment, the height to the top of the lubricator 252 can be approximately 100 feet from the earth surface 101. Depending on the overall length requirements, other lubricator suspension systems (fit-for-purpose completion/workover rigs) may also be used. Alternatively, to reduce the overall surface height requirements, a downhole lubricator system similar to that described in U.S. Pat. No. 6,056,055 issued May 2, 2000 may be used as part of the surface equipment 250 and completion operations.

The lubricator 252 is suspended over the wellbore 100 by means of a crane arm 254. The crane arm 254 is supported over the earth surface 101 by a crane base 256. The crane base 256 may be a working vehicle that is capable of transporting part or all of the crane arm 254 over a roadway. The crane arm 254 includes wires or cable 258 used to hold and manipulate the lubricator 252 into and out of position over the wellbore 100. The crane arm 254 and crane base 256 are designed to support the load of the lubricator 252 and any load requirements anticipated for the completion operations.

A wellhead 270 is provided above the wellbore 100 at the earth surface 101. The wellhead 270 is used to selectively seal the wellbore 100. During completion, the wellhead 270 includes various spooling components, sometimes referred to as spool pieces. The wellhead 270 and its spool pieces are used for flow control and hydraulic isolation during rig-up operations, stimulation operations, and rig-down operations.

The spool pieces may include a crown valve 272. The crown valve 272 is used to isolate the wellbore 100 from the lubricator 252 or other components above the wellhead 270. The spool pieces also include a lower master fracture valve 225 and an upper master fracture valve 235. These lower 225 and upper 235 master fracture valves provide valve systems for isolation of wellbore pressures above and below their respective locations. Depending on site-specific practices and stimulation job design, it is possible that one of these isolation-type valves may not be needed or used.

The wellhead 270 and its spool pieces may also include side outlet injection valves 274. The side outlet injection valves 274 provide a location for injection of stimulation fluids into the wellbore 200. The piping from surface pumps (not shown) and tanks (not shown) used for injection of the stimulation fluids are attached to the injection valves 274 using appropriate fittings and/or couplings. The stimulation fluids are then pumped into the production casing 130.

In the view of FIG. 2, the lubricator 252 has been set down over the wellbore 100. An upper portion of the illustrative wellbore 100 is seen. The wellbore 100 again defines a bore 105 that extends from the surface 101 of the earth, and into the earth's subsurface 110. In FIG. 2, a string of surface casing 130 is again shown. The surface casing 130 has an upper end 132 in sealed connection with the lower master fracture valve 225. The surface casing 130 also has a lower end 134. The surface casing 130 is secured in the wellbore 100 with a surrounding cement sheath 135. It is understood that the surface casing 130 and other wellbore components are not to scale.

The wellbore 100 also includes a string of production casing 150. The production casing 150 is also secured in the wellbore 100 with a surrounding cement sheath 155. The production casing 150 has an upper end 245 in sealed connection with an upper master fracture valve 235. The production casing 150 also has a lower end (not shown). It is understood that the wellbore 100 will also have one or more intermediate strings of casing (such as shown at 140 in FIG. 1).

Referring again to the surface equipment 250, the surface equipment 250 also includes a wireline 285. Wellbore tools are deployed at the end of the wireline 285. As is conventional, the wireline 285 may be routed through a pulley 259 or other means for facilitating the extension and the withdrawal of the wireline. To protect the wireline 285, the wellhead 270 may include a wireline isolation tool 276. The wireline isolation tool 276 provides a means to guard the wireline 285 from direct flow of proppant-laden fluid injected into the side outlet injection valves 274 during a formation fracturing procedure.

The surface equipment 250 is also shown with a blow-out preventer 260. The blow-out preventer 260 is typically remotely actuated in the event of operational upsets. The lubricator 252, the crane arm 254, the crane base 256, the wireline 285, and the blow-out preventer 260 represent standard equipment known to those skilled in the art of well completion.

It is understood that the various items of surface equipment 250 and components of the wellhead 270 are merely illustrative. A typical completion operation will include numerous valves, pipes, tanks, fittings, couplings, gauges, pumps, and other devices. Further, downhole equipment may be run into and out of the wellbore using an electric line, coiled tubing, or a tractor. Alternatively, a drilling rig or other platform may be employed, with jointed working tubes being used.

The lubricator 252 and other items of surface equipment 250 are used to deploy various downhole tools such as fracturing plugs and fracturing guns. Beneficially, the present inventions include apparatus and methods for a seamless process for perforating and stimulating subsurface formations at sequential intervals. Such technology may be referred to herein as Just-In-Time-Perforating™ ("JITP") process. The JITP process allows an operator to fracture a well at multiple intervals with limited or even no "trips" out of the wellbore. The process has particular benefit for multi-zone fracture stimulation of tight gas reservoirs having numerous lenticular sand pay zones. For example, the JITP process is currently being used to recover hydrocarbon fluids in the Piceance basin.

The JITP technology is the subject of U.S. Pat. No. 6,543,538, entitled "Method for Treating Multiple Wellbore Intervals." The '538 patent issued Apr. 8, 2003, and is incorporated by reference herein in its entirety. In one embodiment, the '538 patent generally teaches:

- using a perforating device, perforating at least one interval of one or more subterranean formations traversed by a wellbore;
- pumping treatment fluid through the perforations and into the selected interval without removing the perforating device from the wellbore;
- deploying or activating an item or substance in the wellbore to removably block further fluid flow into the treated perforations; and
- repeating the process for at least one more interval of the subterranean formation.

U.S. Pat. No. 6,394,184 covers an apparatus and method for perforating and treating multiple intervals in one or more subterranean formations. The '184 patent issued in 2002 and is entitled "Method and Apparatus for Stimulation of Multiple Formation Intervals." The '184 patent is referred to and incorporated herein by reference in its entirety.

In one aspect, the '184 patent provides a bottom-hole assembly ("BHA"). The BHA includes a perforating tool and a re-settable packer. The BHA allows the operator to perforate the casing along various intervals of interest, and then sequentially isolate the respective intervals of interest so that fracturing fluid may be injected into the different intervals in the same trip. The re-settable packer is used to provide isolation between intervals, while the perforating tool is used to perforate the multiple intervals in a single rig-up and wellbore entry operation. This technology is named "Annular Coiled Tubing FRACturing" (ACT-Frac).

The Just-in-Time Perforating ("JITP") and the Annular-Coiled Tubing Fracturing ("ACT-Frac") technologies provide stimulation treatments to multiple subsurface formation targets within a single wellbore. In particular, the JITP and the ACT-Frac techniques: (1) enable stimulation of multiple target intervals or regions via a single deployment of downhole equipment; (2) enable selective placement of each stimulation treatment for each individual interval to enhance well productivity; (3) provide diversion between intervals to ensure each interval is treated per design and previously treated intervals are not inadvertently damaged; and (4) allow for stimulation treatments to be pumped at high flow rates to facilitate efficient and effective stimulation. As a result, these multi-interval stimulation techniques enhance hydrocarbon recovery from subsurface formations that contain multiple stacked subsurface intervals.

Despite the time- and cost-saving benefits offered by these tools and corresponding processes, perforation and acidization jobs are sometimes only marginally effective in low-permeability formations having high ductility. An example of a formation having high ductility is a shale formation having a Poisson's ratio greater than 0.25. Another example is a formation having a Young's Modulus less than $3.5\times10^6$ psi.

Hydraulic pressure may be applied to a highly ductile formation in order to form fractures. However, fractures formed in such formations tend to be relatively short, that is, only a few meters long, rather than the 10's or even 100's of meters long frequently experienced in traditional sandstones and more brittle formations. Short hydraulic fractures tend to occur in ductile formations because the work (or energy) required to propagate a fracture tip is relatively large compared to the work required to widen the fracture. The result is that fractures in ductile formations have a greater tendency to widen along the fracture faces rather than extend as fracturing fluid is injected.

To attempt to create longer fractures, the operator may choose to increase injection rates and fluid volumes. However, in ductile formations, generation of long fractures may require an uneconomically large amount of fracturing fluid and proppant considering that the resulting fractures will still be of considerably greater volume than a narrow fracture.

An ancillary problem that arises with wide fractures is that the fractures may not be effectively and uniformly propped when hydraulic pressure is released. This may be especially true if a low viscosity fluid, such as slick water, is used. "Slick water" is a term used for a low-viscosity fracturing fluid, typically having a turbulent flow modifier to aid high flow rate injection. Low-viscosity fluids are less efficient at suspending proppant material. When the proppant is being placed, wider fractures aid settling and the proppant grains quickly settle into the bottom portions of the fractures. Thus, the upper parts of the hydraulic fractures may be left ineffectively propped.

It is known to add polymeric viscosifiers to the injected fluid to help suspend proppant. Furthermore, viscosifiers can significantly reduce the amount of fracturing fluid needed by reducing leak-off from the primary fractures. However, viscosifiers tend to unacceptably foul the fracture faces in low permeability shales. Therefore, improved methods for creating propped fractures are desired.

A method is disclosed herein for hydraulically fracturing subterranean formations so as to provide propped fractures. The method is particularly appropriate for ductile formations. Such formations include, for example, gas-containing shales containing greater than 20 wt. %, 30 wt. %, or even 40 wt. % clay content. The method allows for improved hydrocarbon production.

Figure 3:
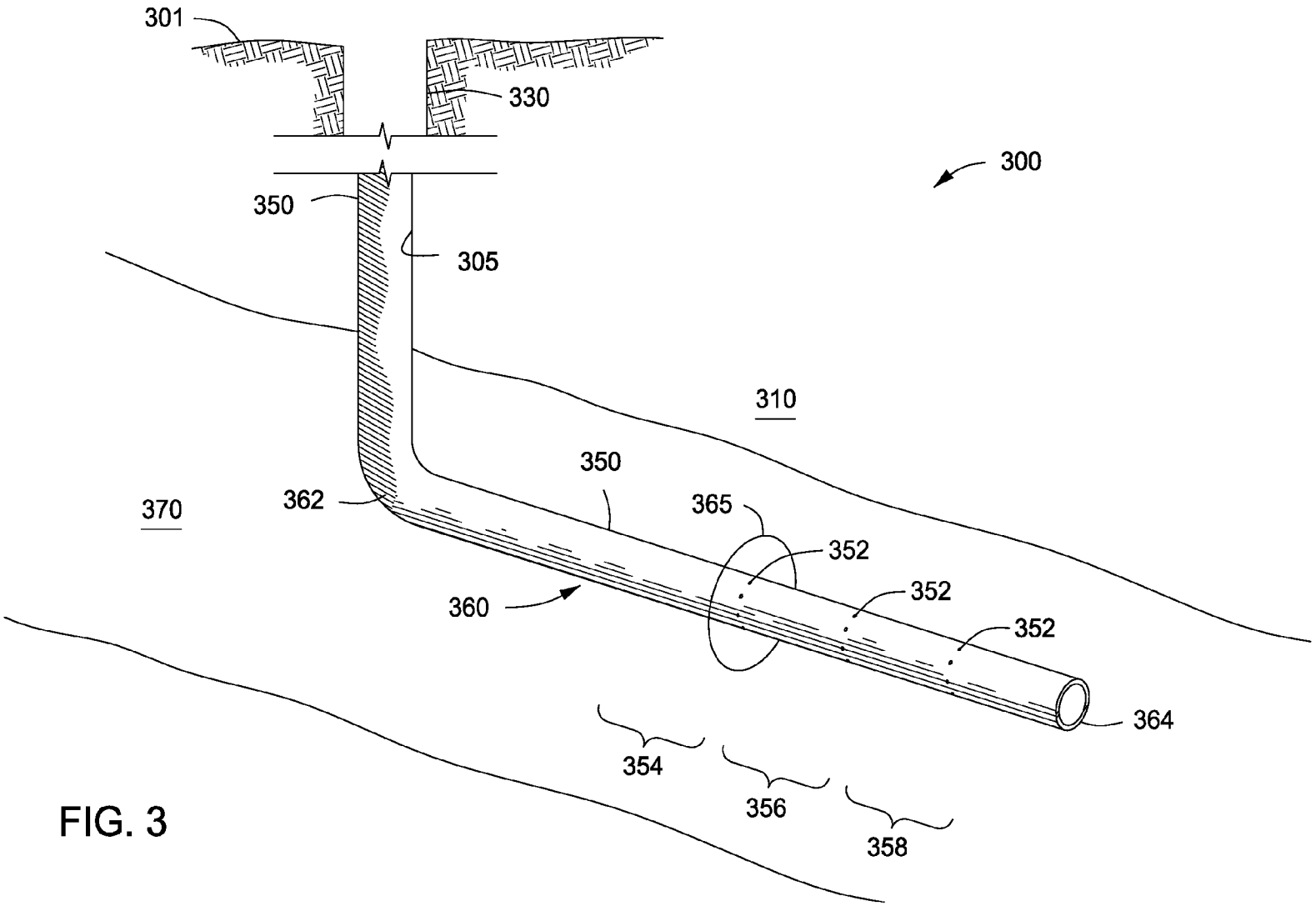
FIG. 3 is a perspective view of the wellbore of FIG. 1 undergoing a fracturing operation. The wellbore is being completed horizontally, and is being fractured along the three illustrative intervals.

FIG. 3 is a perspective view of a wellbore 300 undergoing a fracturing operation. The wellbore 300 is being completed horizontally along a subsurface formation 370. A horizontal portion of the wellbore 300 is seen at 360. The wellbore 300 may be analogous to or after the manner of the wellbore 100 of FIG. 1.

Generally, the wellbore 300 includes one or more casing strings. The wellbore 300 and its casing strings form a bore 305 that extends from an earth surface 301 into a subsurface 310. The casing strings will include a surface casing 330. The casing strings will further include a production casing 350. The casing strings will further most likely include one or more intermediate casing strings (not shown).

The production casing 350 resides primarily along the horizontal portion 360 of the wellbore 300. The production casing 350 will have a heel 362 and a toe 364. The production casing 350 has been perforated between the heel 362 and the toe 364. Perforations are seen at 352.

In the arrangement of FIG. 3, the production casing 350 has been divided into three illustrative intervals. Those are shown at 354, 356, and 358. Hydraulic fluid is being injected through the perforations 352 along interval 354, thus forming a hydraulic fracture 365 into the surrounding subsurface formation 370. The hydraulic fracture 365 is shown as an ellipse. Subsequently, fluid may be injected sequentially through perforations 352 created in intervals 356 and 358 to likewise form hydraulic fractures.

In the illustrative embodiment of FIG. 3, each interval 354, 356, 358 has a single set of perforations 352. However, the methods claimed herein are not limited to such an arrangement unless expressly provided. Specifically, the present inventions are not limited to the arrangement or number of the perforations or to the manner in which the perforations are made. The perforations can be any shape, size, number, or arrangement.

In accordance with the present methods, two or more injection stages are undertaken. These stages are demonstrated in FIGS. 4A through 4D.

Figure 4A:
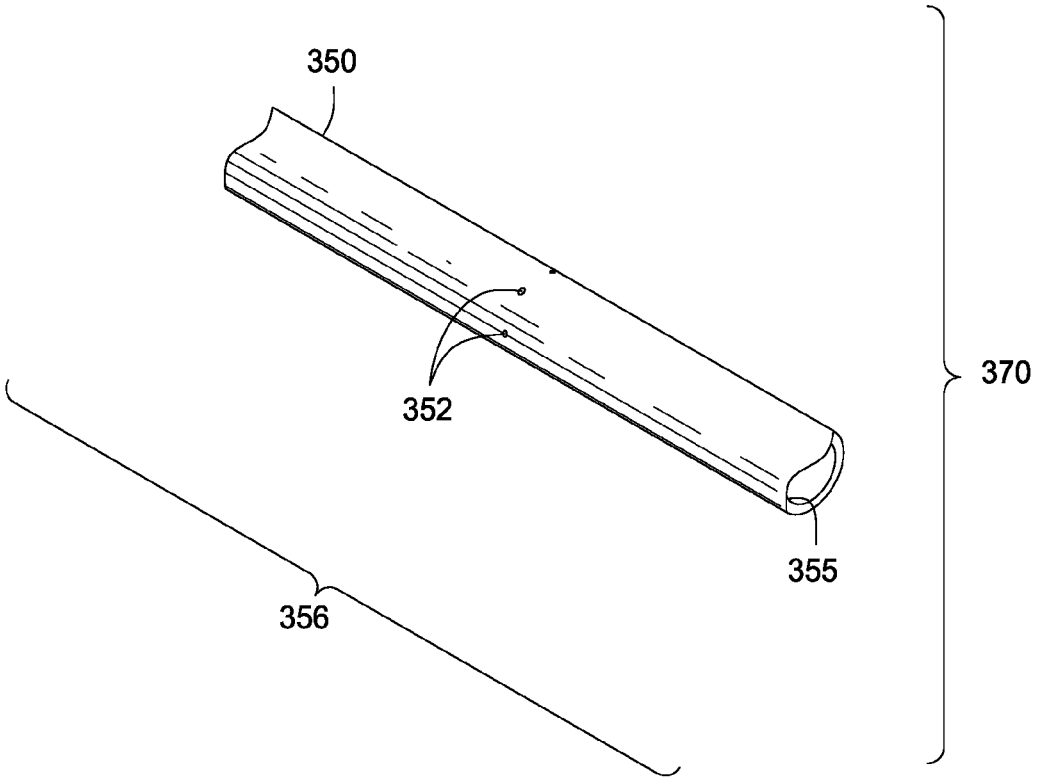

FIGS. 4A, 4B(1), 4C(1), and 4D(1) provide perspective views of a portion of the production casing 350 from FIG. 3. The illustrative portion represents interval 356. The production casing 350 is set within the subsurface formation 370. The illustrative formation 370 defines a ductile rock matrix.

It is desirable to create propped fractures in the formation 370. Accordingly, the production casing 350 has a bore 355 through which hydraulic fluids are injected for fracturing. In order to inject a fracturing fluid through the production casing 350, the casing 350 has been perforated. Perforations are again shown at 352. However, in FIG. 4A hydraulic fluid is not yet being injected into the bore 355 and through the perforations 352.

FIG. 4B(1) shows a next stage in the formation of a propped fracture. In FIG. 4B(1), hydraulic fluid is being injected into the bore 355 and through the perforations 352. The hydraulic fluid represents a first fluid. The first fluid has a first proppant concentration that is preferably less than 10 vol. %. More preferably, the first proppant concentration is 0 to 5 vol. %, and even more preferably essentially zero. The first fluid is being injected into the formation 370. The result is the formation of a first fracture 365'.

FIG. 4B(2) shows an enlarged view of the first fracture 365' from FIG. 4B(1). The fracture 365' is extending outwardly from the production casing 350. The fracture 365' has a base 351 proximate the casing 350, and a fracture tip 357. The fracture 365' has a first length $L_1$.

The fracture 365' in FIG. 4B(2) also has a first width $W_1$. The width $W_1$ may be greater than 5 mm, 20 mm, or even greater than 50 mm if created in ductile rock. Preferably, an amount or volume of the hydraulic first fluid is predetermined to create the first length $L_1$.

The first fluid may be slick water. However and more preferably, the first fluid may contain viscosifiers such as cross-linking polymers, gels, or other thickening materials to reduce fluid leak-off.

FIG. 4C(1) shows a next stage in the formation of a propped fracture. In FIG. 4C(1), hydraulic fluid is no longer being injected through the perforations 352. Further, pressure has been substantially released from the first fracture 365'.

FIG. 4C(2) shows an enlarged view of the fracture 365' from FIG. 4C(1). The fracture 365' is again extending outwardly from the production casing 350. The fracture 365' has a base 351 proximate the casing 350, and a fracture tip 357. However, the fracture 365' has contracted.

The contracted fracture 365' in FIG. 4C(2) is shown as having a contracted width $W_c$, which is less than width $W_1$ in FIG. 4B(2). In actuality, the fracture 365' in FIG. 4C(1) may be substantially closed, particularly if no or minimal proppant was injected.

FIG. 4D(1) shows a next stage in the formation of a propped fracture. In FIG. 4D(1), a second fluid is being injected into the bore 355 and through the perforations 352. A second fracture 365" is being formed. The second fracture 365" is actually a re-opening of the first fracture 365'.

The second fluid has a second proppant concentration which is higher than the proppant concentration of the first fluid. For example, the second fluid may contain at least two pounds of proppant per gallon of (proppant-free) fracturing fluid (0.23 kg/liter).

The second fluid may also comprise one or more additives to improve the subsequent flow from the formation 370 into the fracture 365". This may be particularly desirable if the first fracturing fluid contains viscosifiers that purposely or otherwise clog the pores along the faces of the first fracture 365'. For example, the second fluid may contain a viscosifier-breaker such as bleach or other oxidizer. The additive may alternatively be a surfactant or brine to clean out viscosifiers used to reduce leak-off.

Preferably the second fluid is substantially less viscous than the first fluid. For example, the first fluid may contain a viscosifier whereas the second fluid is a slick water fluid. Alternatively, the second fluid may have a viscosity that is at least 10, 100, or even 1,000 times less viscous than the first fluid, at common shear rate and temperature conditions.

In the stage of FIG. 4D(1), the second fluid is further being injected into the formation 370. The result is that fracture 365" is reopened. In some embodiments, sufficient second fluid is injected to extend the size of fracture 365'. Preferably the size of the second fracture 365" after injection of the second fluid is similar to that of the first fracture 365' after injection of the first fluid. For example, the fracture length after injection of the second fluid (fracture 365") may be up to 10%, 25%, or even 50% longer than after injection of the first fluid (fracture 365').

FIG. 4D(2) shows an enlarged view of the fracture 365" from FIG. 4D(1). The fracture 365" is extending outwardly from the production casing 350. The second fracture 365" has a base 351 proximate the casing 350, and a fracture tip 357. The fracture 365" has a second length $L_2$. The second length $L_2$ may be similar to or longer than the first length $L_1$. In the illustrative fracture 365" of FIG. 4D(2), $L_2$ is greater than $L_1$.

The second fracture 365" in FIG. 4D(2) generally has a second width $W_2$. The second fracture 365" may have sections of 1 to 20 mm, or more. However, the second width $W_2$ will preferably be narrower than the first width $W_1$. Preferably, an amount or volume of the hydraulic second fluid is predetermined to create the second length $L_2$.

Since a first fracture 365' already exists in the formation 370, re-opening the fracture to form the second fracture 365" is geomechanically equivalent to fracturing a brittle rock. This is because the work required to widen the existing fracture is much greater than the work required to re-open a closed fracture, i.e., to propagate an "unzipping" of a closed fracture, since no new rock breakage needs to occur. Thus, the geometry of the second (or reopened) fracture 365" will be different than the first (or original) fracture 365'. In particular, the geometry of the second (or reopened) fracture 365" will be similar to that of a brittle-like fracture in that it will be relatively narrow.

The fracture tip 357 in the second fracture 365" may have been extended. This means that $L_2$ may be greater than $L_1$. Because the width of the second fracture 365" is narrow, the second fracture 365" is better able to retain proppant in a well-distributed manner when pressure is released from the formation 370. Stated another way, proppant more readily bridges across a narrow fracture (such as second fracture 365") than a wide fracture (such as first fracture 365') and thus hinder settling. An additional benefit of a narrow fracture is that the volume of proppant needed to fill the fracture is reduced over that of a wide fracture, thereby reducing overall cost.

The double-fracturing procedure shown in FIGS. 4A through 4D offers a method for generating large, effectively propped fractures in subterranean ductile rock formations, such as certain gas-containing shales. Specifically, the procedure has utility in ductile formations such as shales containing greater than about, for example, 40 wt. % clay.

The process offered in FIGS. 4A through 4D helps to provide effective flow paths from a ductile formation to wells connected to the surface. The process is demonstrated in the context of fractures emanating from a horizontal production casing 350. However, the process may be applied in the creation of fractures emanating from a vertical or a deviated wellbore.

In any instance, the operator may conduct the fracturing process along multiple wellbore intervals using moveable, or inflatable, packers. The inflatable packers sequentially isolate or direct the first fluid into a selected interval or intervals to create the first fracture. Alternatively or in addition, moveable packers may be used to sequentially direct the second fluid into selected intervals to prop the previously created fractures.

In FIG. 1, inflatable packers 182, 184 are shown, isolating three contiguous intervals 154, 156, 158. In this instance, the three intervals 154, 156, 158 are fractured simultaneously. However, simultaneous creation of multiple fractures is seldom possible with traditional hydraulic fracturing. This is because after a pressurized fracturing fluid initiates a first fracture within a formation, the fracture's growth prevents the fracturing fluid's pressure from increasing further and initiating subsequent fractures.

Figure 5:
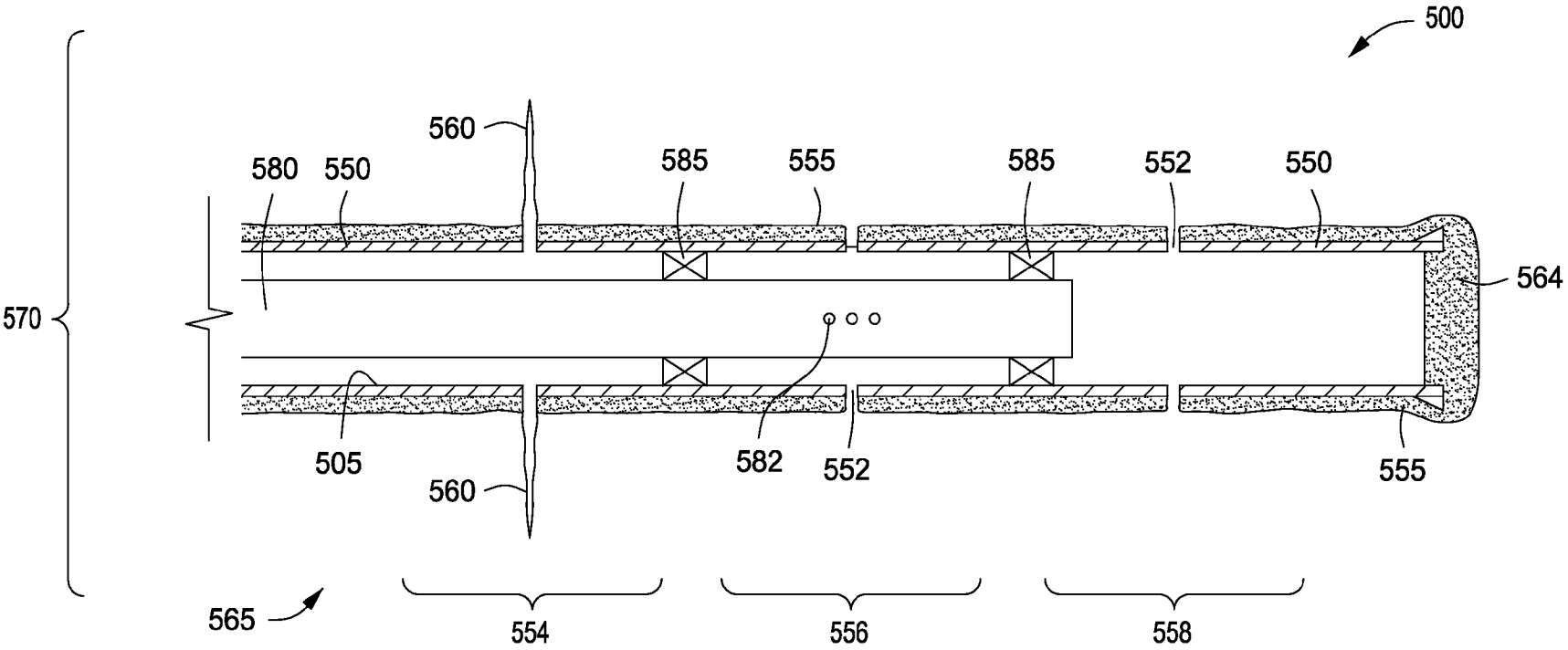
FIG. 5 is a side, cross-sectional view of a wellbore. The wellbore has been completed horizontally. The production casing has been perforated along three illustrative intervals.

For economic considerations, it is generally desirable to produce multiple fractures along a wellbore using a single trip of the fracturing tool. As previously discussed, methods are known in the art for doing this. In one embodiment of the invention, inflatable packers are employed to create fractures in adjoining intervals sequentially. FIG. 5 is a side, cross-sectional view of a wellbore 500. The wellbore 500 has been completed horizontally within a subsurface formation 570. Only a lower portion 565 of the wellbore 500 is shown.

The lower portion 565 (or horizontal section) has a heel (not shown). Further, the lower portion 565 has a toe 564. Extending along the lower portion 565 is a string of production casing 550. The production casing 550 is cemented into place through a cement sheath 555. The production casing 550 forms a pathway 505 through which fracturing fluids may be injected. The production casing 550 also has perforations 552 that have been formed therein.

The production casing 550 has been segregated into three separate intervals. These are indicated at 554, 556, and 558. Perforations 552 are provided along the casing 550 within each interval 554, 556, 558. In addition, a fracture 560 is seen having been formed in the subsurface formation 570 within interval 554.

In order to generate the fractures 560, a string of coiled tubing is run into the wellbore 500. A lower end of the string of coiled tubing is shown at 580. The coiled tubing 580 has ports 582. The ports 582 may be selectively opened and closed using sliding sleeves or valves (not shown). In addition, the coiled tubing 580 has inflatable packers 585. In the arrangement of FIG. 5, two inflatable packers 585 are shown. The packers are annular in shape and surround the coiled tubing 580.

The inflatable packers 585 may be selectively inflated and deflated. When inflated, the packers 585 are used to isolate a perforated interval. Fluid is then injected through ports 582 to form a hydraulic fracture 560. In the arrangement of FIG. 5, a fracture 560 has been previously formed at interval 554. The coiled tubing 580 is now positioned such that the inflatable packers 585 straddle perforations 552 in interval 556. The packers 585 have been inflated and fluid is ready to be injected to create a fracture in interval 556.

After a hydraulic fracture 560 is formed in an interval, the inflatable packers 585 are deflated. The coiled tubing 580 is then repositioned into a new interval and the packers 585 are re-inflated to provide isolation. This allows multiple fractures to be created in the subsurface formation 570 using a single trip of the coiled tubing 580.

The use of inflatable packers 585 straddling a subsurface interval as shown in FIG. 5 is particularly beneficial when forming the first fractures. However, it is feasible to simultaneously pressurize, reopen, and prop two or more of the second fractures with the second fluid. This is because the fracture pathways have already been formed in connection with the first fractures. Thus, the second fluid should readily invade, pressurize, and reopen the fractures to create the second fractures, and to extend the fracture tips. In such a case, the inflatable packers 585 would be applied so as to straddle two or more intervals.

Figure 6:
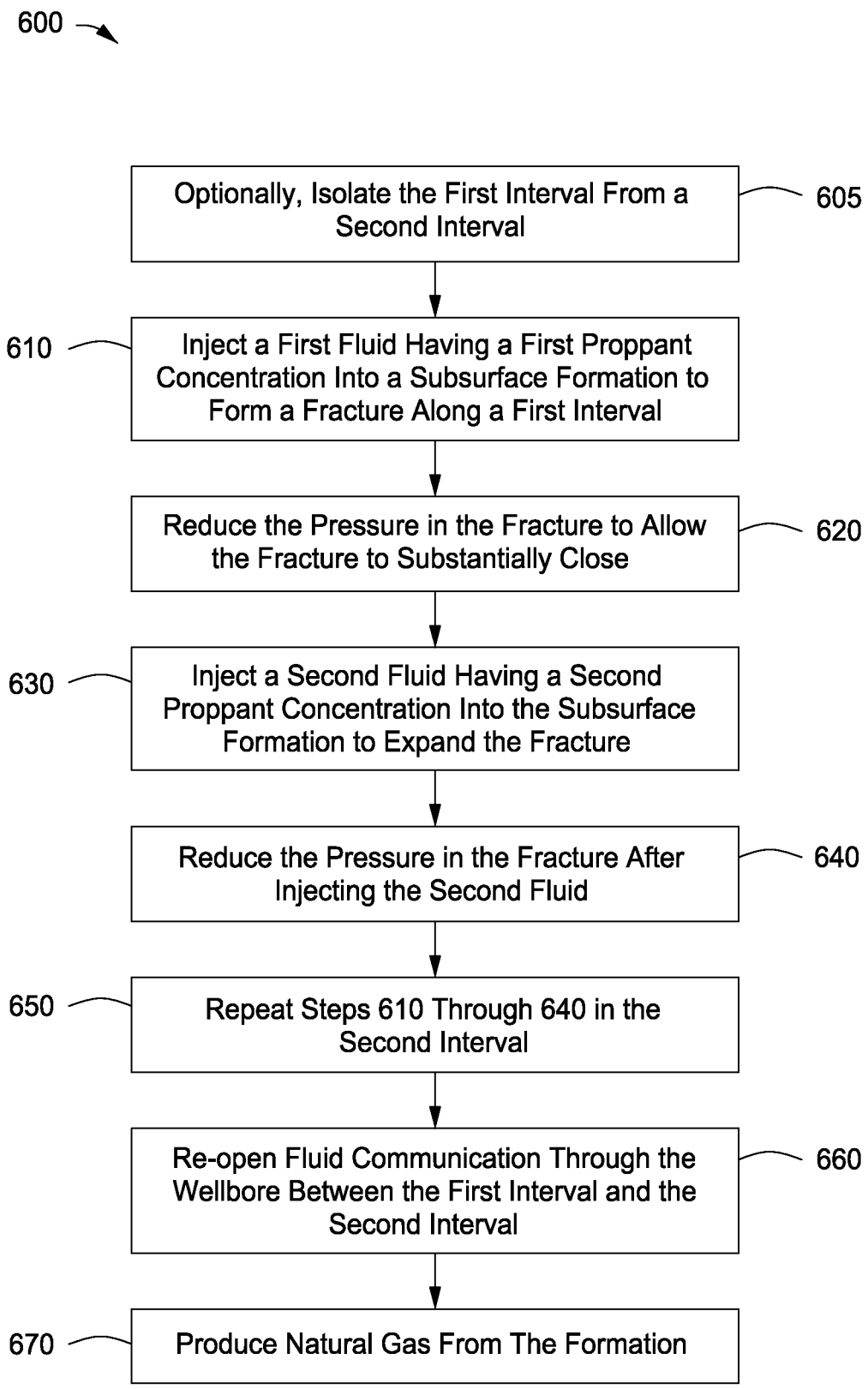
FIG. 6 is a flowchart showing steps for fracturing a formation, producing propped fractures.

FIG. 6 presents a flow chart for methods 600 of forming one or more propped fractures in a subsurface formation. In the methods 600, the fractures are formed outwardly from a wellbore. The formation is preferably a ductile formation. For example, the formation may be a shale formation having a Poisson's ratio greater than about 0.25. Alternatively, the formation may be a formation having a Young's Modulus less than about $3.5\times10^6$ psi.

The methods 600 first comprise injecting a first fluid into the subsurface formation This is provided at Box 610. The injection step of Box 610 is a first injecting step, and serves to form one or more fractures. The amount of first fluid injected may be predetermined to generate a fracture of approximately a desired length.

The first fluid has a first proppant concentration. The first fluid may be primarily slick water, but preferably includes additives to reduce leak-off. The additives may comprise viscosifiers or particulates. Preferably, the proppant concentration is effectively zero, that is, less than about 1% vol. Alternatively, the proppant concentration in the first fluid may be less than about 10% vol.

The methods 600 also include reducing the pressure in the fracture. This is shown at Box 620. Reducing the pressure allows the ductile fracture to contract. In some cases, the contracting step of Box 620 may mean that a fracture formed from the first injecting step (Box 610) substantially closes.

In some implementations, the first fluid vaporizes upon the reducing of pressure step (Box 620), as will be described more fully below. The first fluid may comprise, for example, carbon dioxide or propane.

The methods 600 further include injecting a second fluid into the one or more fractures. This is seen at Box 630. The injecting step of Box 630 represents a second injecting step.

The second fluid that is injected in the second injecting step has a second proppant concentration. The second proppant concentration is greater than the first proppant concentration. Preferably, the second proppant concentration is designed to provide sufficient proppant to create permeability within the fractured formation and to permit subsequent commercial hydrocarbon recovery from the formation.

The methods 600 include again reducing the pressure in the fracture. This is shown at Box 640. In accordance with the methods 600, proppant remains in the fracture after pressure is reduced, creating a propped fracture.

In one aspect, the fracture has a first estimated length $L_1$ after the first injecting step (Box 610), but then a second estimated length $L_2$ after the second injecting step (Box 630). Preferably, the second length $L_2$ is similar or only moderately greater in length than the first length $L_1$. Preferably, the amount of first fluid injected is predetermined to generate a fracture of the first length $L_1$, while the amount of second fluid injected is predetermined to generate a fracture of the second length $L_2$.

If the first fluid includes a first agent which reduces leak-off, it is preferred that the second fluid includes a second agent to reduce any lingering effects of the first agent. This is to maximize the effectiveness of the fracture to act as a means to aid hydrocarbon production from the formation. For example, if the first fluid included a viscosifying agent, the second fluid may contain an agent which accelerates degradation of the viscosifying agent. Such an agent may be an oxidizer, such as bleach or a bleaching agent.

The first fluid, the second fluid, or both may also comprise an additive for reducing fluid leak-off into the formation. The additive may be, for example, a particulate material. An example of a particulate material is clay particles (such as bentonite).

It is noted here that the cost of hydraulic fracturing is significantly dependent on the amount of rig time required to perform the procedure. Thus, optimizations to reduce rig time generally reduce overall cost. In order to reduce rig time incident to the present method 600, the operator may choose to use a first fluid which can be at least partially produced as a vapor. This reduces the time required to depressurize the fractures prior to injecting the second fluid.

To produce the first fluid as a vapor, the operator chooses a first fluid for injection (Box 610) that can be vaporized when the fracture is depressurized (Box 620). For example, the liquid may be carbon dioxide or propane. Alternatively, the first fracturing fluid may be injected as a vapor and stay as a vapor throughout. In this instance, the first fluid may be nitrogen.

The methods 600 may be employed when the subsurface formation has more than one interval. For example, the operator may provide propped fractures in one interval in accordance with the steps of Boxes 610 through 640. The operator may isolate the first interval from a second interval. This is provided in Box 605. Thereafter, the fracturing and propping steps of Boxes 610 through 640 are repeated for the second interval. This is indicated at Box 650. Thereafter, the method 600 includes re-opening fluid communication through the wellbore between the first interval and the second interval. This is shown in Box 660.

The process described above may be employed for third, fourth, or more intervals. In any instance, the method 600 may finally includes producing natural gas from the subsurface formation. This is indicated at Box 670.

The methods 600 are ideal for wellbores that are completed horizontally. Some horizontal wells have multiple intervals along a substantially horizontal well section. In this instance, the fractures formed from the various intervals typically propagate substantially vertically.

In one preferred embodiment, the first injection step (Box 610) creates fractures within a plurality of intervals. The second injecting step (Box 630) simultaneously pressurizes the fractures within each of the plurality of intervals. The second fluid props two or more fractures in each of the intervals upon the reducing of pressure step (Box 640).

The methods 600 offer improved methods for forming propped fractures in a subsurface formation. In certain aspects, the methods 600 allow for the formation of extended fractures in ductile formations while minimizing proppant and fluid needs. The methods 600 also promote effective distribution of proppant within the fractures.

As discussed above, the presently disclosed methods include injecting a second fracturing fluid into the originally created one or more fractures. This injecting step represents a second injecting step, but may in fact be a third or subsequent injection step, but for simplicity and explanation purposes, such follow-up pumping steps are referred to herein as "second" pumping steps and involve a corresponding or "second" fluid. It is also recognized that the first pumping step and/or the second pumping step may also be divided into separate pumping stages without departing from the scope of the invention. Each step and/or stage within the steps, may also utilize different, similar, or substantially similar fluid types, and may also include additional fluids, such as energizing fluids, gels, crosslinkers, breakers, other additives, and/or proppants.

The second fracturing fluid is injected into the fracture formed from the first injecting step. Thus, the second injecting step takes advantage of the flow paths created in the first injecting step to re-open the fracture. In one embodiment, the fluid volume and pressure of the second fracture fluid injection step is chosen so as not to significantly extend the first or previously made fracture, but merely reopen and (as described below) prop portions or substantially all of it. The injection of the second fluid is performed relatively soon after the aforementioned reduction of pressure activity, such that both fluid injection operations may generally be considered to be part of a consolidated formation completion program. In this context the term "soon" generally means prior to production of native formation fluid (e.g., gas, oil, and/or water) from the subsurface formation on a commercial (or substantial commercial) level. Some natural gas may be produced in the course of the reduction of pressure activity but it is understood that this simply a transitory regime during the completion process. The intermittent depressurization step may function to serve the completion process, such as to clean out the fracture of a substantial portion of the injected fluid, as opposed to primarily produce native fluids. A brief well flow test, or pressure transient test, and/or even a wellbore cleanout step, may also be performed during the depressurization step between the two stimulation fluid injection steps, and such embodiments are considered within the scope of the disclosed and claimed methods. Preferably, the second fluid injection step is performed using some, if not much, of the same flowline and pump equipment as the first fluid injection step without need to demobilize equipment in between. Hence, the total completion time to conduct all steps of the method may typically be on order of hours or several days (e.g., up to 3, 7, or 14 days), but does not include re-stimulation methods that include periods of substantial commercial production or performance of other non-completion-oriented activities during the depressurization period. Timing of the steps is well or fact specific, and will vary depending upon a number of completion design, logistical, and engineering variables.

The second fluid that is injected in the second injecting step has a second proppant concentration. The second proppant concentration is greater than the first proppant concentration. In some embodiments, the first proppant concentration may be zero or negligible, whereas the second proppant concentration is sufficient to prop the fractures to allow commercial production rates.

As discussed previously, the methods include again reducing the pressure in the fractures. In accordance with the methods, proppant remains in the one or more fractures after pressure is reduced. In this way, propped fractures are created. Native fluids may then be effectively produced from the subsurface formation. The amount of native fluids produced from the subsurface formation after this final propped fracture is created should be dramatically more than any native fluids produced in between the first injection and second injection steps, if any at all was produced between the first and second injection steps. That is, long-term commercial production only occurs after the second injection step. Stated differently, the amount of gas produced (by volume) after completion of the second injection step is at least 1000 times greater, or even 10,000 times greater than an amount produced during the double fracturing process, such as after the first injection step. The amount produced after the first step is generally considered incidental or if significant is only considered to be affiliated with well testing and is not considered well production.

It is noted that the present invention is distinguished from so-called prior art "re-fracturing" (which is a common practice in some shale gas plays). In re-fracturing, one or more hydraulic fractures are formed in a well and then followed by commercial production. Over time (generally several months or years) the production rate declines. To restore productivity from the declined well, traditional re-fracturing is done in the well in the same completion regions as the first fractures so to primarily contact new rockface (not the same rockface of the first fractures, as in the present invention). In distinction, the presently disclosed process is designed to primarily involve re-opening the original fracture face. However, it is recognized that in pumping the second fracturing fluid injection step, some new fractures may be created in conjunction with reopening the originally created fracture plane(s).

In one aspect, the fracture has an estimated first length after the first injecting step, and then an estimated second length after the second injecting step. Preferably, the amount of first fluid injected is predetermined to generate a fracture of the estimated first length, while the amount of second fluid injected is predetermined to generate a fracture of the estimated second length. Fracture length may be estimated through any of several methods known in the art. For example, fracture length may be estimated by modeling based on injected fluid volumes, fluid rheology, rock permeability, and rock mechanics. Fracture length may also be estimated by interpretation of micro-seismic data collected during hydraulic fracturing.

In many embodiments of the presently disclosed techniques, the estimated or calculated second fracture length is determined to be substantially similar to that of the estimated first fracture length. For example, the estimated or calculated and propped second fracture length may be substantially the same as or even slightly less than the originally created fracture length. In other embodiments, the second fracture length may be determined to be, no more than up to 10%, 25%, or 50%, or even up to 100% longer than the estimated or calculated first length, but is generally not more than 100% longer than (e.g., two times) the originally created fracture length. All of only portions of the created second fracture may be propped. The second fracture may also be pumped in stages, with each stage having a unique pad size and/or proppant loading, and may be over flushed, under flushed, or substantially even-flushed with respect to the wellbore volume.

While it will be apparent that the inventions herein described are well calculated to achieve the benefits and advantages set forth above, it will be appreciated that the inventions are susceptible to modification, variation and change without departing from the spirit thereof.

What is claimed is:

1. A method of forming a propped fracture outwardly from a wellbore in a subsurface formation, the method comprising:

(a) injecting a first fluid having a first proppant concentration into the subsurface formation to form a fracture having a first opening width, wherein the first proppant concentration may be zero, and wherein the subsurface formation is ductile and has at least one of a Poisson's ratio greater than or equal to 0.25 and a Young's Modulus not greater than $3.5\times10^6$ psi ($2.4\times10^4$ MPa);

(b) reducing pressure in the fracture so as to allow the fracture to substantially close;

(c) injecting a second fluid having a second proppant concentration into the fracture to re-open the fracture, wherein the second proppant concentration is greater than the first proppant concentration and wherein the re-opened fracture has a second opening width which is less than the first opening width; and (d) reducing the pressure in the fracture after injecting the second fluid into the fracture, wherein a portion of proppant from the second fluid remains in the fracture to prop the fracture.

2. The method of claim 1, wherein the first proppant concentration is zero.

3. The method of claim 1, wherein the first proppant concentration is less than about 10% vol.

4. The method of claim 1, wherein:

the fracture has a first length after the first injecting step (a); and the fracture has a second length after the second injecting step (c).

5. The method of claim 4, wherein the second length is not greater than two times the first length.

6. The method of claim 4, wherein the estimated second length is about 10% to 50% greater than the estimated first length.

7. The method of claim 4, wherein the second length is not greater than the first length.

8. The method of claim 4, wherein the second length is not more than 10% greater than the first length.

9. The method of claim 1, wherein the amount of first fluid injected is predetermined to generate a fracture of approximately a desired first length.

10. The method of claim 9, wherein the amount of second fluid injected is predetermined to generate a fracture of approximately a desired second length.

11. The method of claim 1, wherein the second fluid is less viscous than the first fluid by at least a factor of 10 at a common shear rate and temperature condition.

12. The method of claim 1, wherein (i) the first fluid, (ii) the second fluid, or (iii) both comprises an additive which reduces fluid leak-off into the formation.

13. The method of claim 12, wherein the additive is a particulate material.

14. The method of claim 12, wherein the additive is a viscosifier.

15. The method of claim 14, wherein:

the first fluid comprises a viscosifying agent; and the second fluid comprises an agent that degrades the viscosifying agent of the first fluid a period of time after the second injecting step (c).

16. The method of claim 1, wherein:

the second injecting step (c) is performed simultaneously on two or more fractures in the subsurface formation.

17. The method of claim 1, wherein:

the wellbore connects to at least a first interval and a second interval;

steps (a) through (c) are conducted to form a fracture in the first interval; and the method further comprises:

isolating the first interval from the second interval by restricting fluid communication through the wellbore between the first interval and the second interval, performing steps (a) through (c) to form a fracture in the second interval, and re-opening fluid communication through the wellbore between the first interval and the second interval.

18. The method of claim 17, wherein:

the wellbore is formed to have a substantially horizontal well section;

the first interval and the second interval reside along the horizontal well section;

the fractures formed from the first and second intervals propagate substantially vertically.

19. The method of claim 1, wherein:

the wellbore connects to at least a first interval and a second interval;

steps (a) and (b) are conducted to form a fracture in the first interval; and the method further comprises:

isolating the first interval from the second interval by restricting fluid communication through the wellbore between the first interval and the second interval, performing steps (a) and (b) to form a first fracture in the second interval, re-opening fluid communication through the wellbore between the first interval and the second interval, and performing step (c) simultaneously on fractures formed by step (a) in the first and second intervals in order to re-open the fractures.

20. The method of claim 1, wherein the first fluid vaporizes upon the reducing of pressure in step (b).

21. The method of claim 20, wherein the first fluid comprises carbon dioxide or propane.

22. The method of claim 1, further comprising:

producing natural gas from the subsurface formation.

23. The method of claim 22, wherein produced natural gas after step (b) comprises a first amount and the produced natural gas after step (d) comprises a second amount and the second amount is at least 1000 times greater than the first amount.

* * * * *